US008075158B2

(12) United States Patent
Amoraga Rodriguez

(10) Patent No.: US 8,075,158 B2
(45) Date of Patent: Dec. 13, 2011

(54) LIGHT EMITTING DIODE (LED) LIGHTING TUBE THAT CAN BE DISASSEMBLED AND REPAIRED

(76) Inventor: Jose Antonio Amoraga Rodriguez, Barcelona (ES)

( * ) Notice: Subject to any disclaimer, the term of this patent is extended or adjusted under 35 U.S.C. 154(b) by 132 days.

(21) Appl. No.: 12/429,895

(22) Filed: Apr. 24, 2009

(65) Prior Publication Data

US 2010/0091496 A1 Apr. 15, 2010

(30) Foreign Application Priority Data

Oct. 14, 2008 (ES) ..... 200802122 U

(51) Int. Cl.
*F21S 4/00* (2006.01)

(52) U.S. Cl. ..... 362/249.04; 362/249.08; 362/249.02

(58) Field of Classification Search ..... 362/217.01, 362/217.04, 218, 249.02, 249.03, 249.04, 362/249.06, 249.07, 249.08, 260, 311.02
See application file for complete search history.

(56) References Cited

U.S. PATENT DOCUMENTS

| | | | | |
|---|---|---|---|---|
| 5,103,382 | A * | 4/1992 | Kondo et al. | 362/249.04 |
| 5,550,719 | A * | 8/1996 | Kuo | 362/120 |
| 5,585,783 | A * | 12/1996 | Hall | 362/249.02 |
| 6,860,628 | B2 * | 3/2005 | Robertson et al. | 362/260 |
| 7,594,738 | B1 * | 9/2009 | Lin et al. | 362/249.02 |

FOREIGN PATENT DOCUMENTS

JP 3156929 U * 1/2010

* cited by examiner

*Primary Examiner* — Y My Quach Lee
(74) *Attorney, Agent, or Firm* — Egbert Law Offices PLLC

(57) ABSTRACT

The invention relates to a lighting tube with light emitting diodes (LEDs) that can be disassembled and repaired. The present invention presents substantial advantages and innovative characteristics as well as other advantages related to organization and construction. The invention is centered on a lighting tube which, while preferably adopting the standardized dimensions of commonly used fluorescent tubes, as well as a similar system for lateral attachment and connection, is different. It is provided inside the transparent tubular body that forms it with a lighting system based on light emitting diodes or LEDs, giving the tube the advantages of this lighting system, essentially based on a greater illumination intensity with a considerably lower consumption, the possibility of repairing the tube and a much longer useful lifetime.

3 Claims, 1 Drawing Sheet

LIGHT EMITTING DIODE (LED) LIGHTING TUBE THAT CAN BE DISASSEMBLED AND REPAIRED

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The field of application of the present in invention lies in the industry sector related to manufacturing lighting apparatuses and devices.

2. Description of Related Art Including Information Disclosed Under 37 CFR 1.97 and 37 CFR 1.98.

Currently, as a reference to the state of the art, although multiple devices and systems are known that use light emitting diodes (LEDs). It must be noted that the applicant is not aware of the existence of any invention having technical, structural or configuration characteristics similar to those of that disclosed herein.

BRIEF SUMMARY OF THE INVENTION

Thus, the lighting tube based on LEDs (Light Emitting Diodes) that can be disassembled and repaired proposed by the invention is configured with noteworthy novelty within its field of application, as it clearly provides an innovative lighting system with a lower consumption and greater duration, as well as additional advantages, these characterizing details being suitably specified in the final claims appended to this description.

Specifically, the invention consists of a lighting tube externally similar in shape and size to a conventional fluorescent tube, being different in that inside the transparent tubular body it has a lighting system formed by a plurality of LEDs (Light Emitting Diodes) coupled to an internal piece.

Thus, this piece is made of any suitable flexible material and has an elongated rectangular shape and a length identical to that of the transparent tube, which may be made of glass or acrylic glass as desired, and a width preferably somewhat greater than the diameter of said tube, incorporating the LEDs equidistantly distributed along the length and width of its surface. Naturally, the number of LEDs will depend on the size of the tube, the bigger the tube, the more LEDs it will contain and therefore the greater its illumination capacity.

This aforementioned piece is inserted in the tube through one of the ends of the tube and is slightly curved in its middle area as it is wider than the tube, which results in an advantageous opening of the angle of incidence of the light, increasing the illuminated area as the inclination will be convex on its outside part, on which the LEDs are placed, and concave on the opposite side, which is used to incorporate the electronic circuit needed for its operation.

It should be noted that to guide the concave positioning of the piece, the tube is internally provided with a support element with a configuration having angled ends that engages the sides of the piece to ensure that it adopts said curvature. This element is also used to embellish the rear part of the transparent tube, concealing the electronic circuit and the connections of the LEDs.

It is important to point out that on the ends of the transparent tubular body are established corresponding anchoring connectors which, in addition to acting as a cover for closing the ends, are attached to the side tabs of the support case of the assembly and joined to them, as in conventional fluorescent tubes, by the insertion of corresponding lugs in the grooves made in said tabs.

Note that at least one of the anchoring connectors has a threading, with a gasket to provide full tightness of the tube, meant to simplify the extraction of the piece that holds the LEDs from inside the tube and proceed to their replacement and/or repair, as faulty LEDs can be replaced with new ones without having to replace the entire tube. In addition, this anchoring connector is provided with the corresponding connection element for power supply to the electronic circuit. The connector on the opposite end will provide a complementary anchoring.

In view of the above, the advantages provided by the tube of the invention compared to conventional fluorescent tubes are clear. Thus, a LED-based lighting system will use much less power for a given light intensity, and a tube of the same size will provide a greater luminosity and a greater field of illumination. On another hand, the useful lifetime of the lamp is considerably extended, as in addition to the fact that LEDs last longer than fluorescent tubes, the piece holding them can be easily extracted from the tube to allow repairing it or replacing it entirely.

The illumination tube described therefore represents an innovative structure with structural and constitutional characteristics hitherto unknown for this purpose, which joined to its practicality provides sufficient grounds for obtaining the requested privilege of exclusivity

BRIEF DESCRIPTION OF THE SEVERAL VIEWS OF THE DRAWINGS

To complete the description being made and to aid a better understanding of the characteristics of the invention, the present descriptive memory is accompanied by a set of drawings which form an integral part of the description where, for purposes of illustration only and in a non-limiting sense.

DETAILED DESCRIPTION OF THE INVENTION

In view of the figures described above and according to the numbering used, an example of a preferred embodiment is seen comprising the parts specified and described in detail below.

Figure 1:
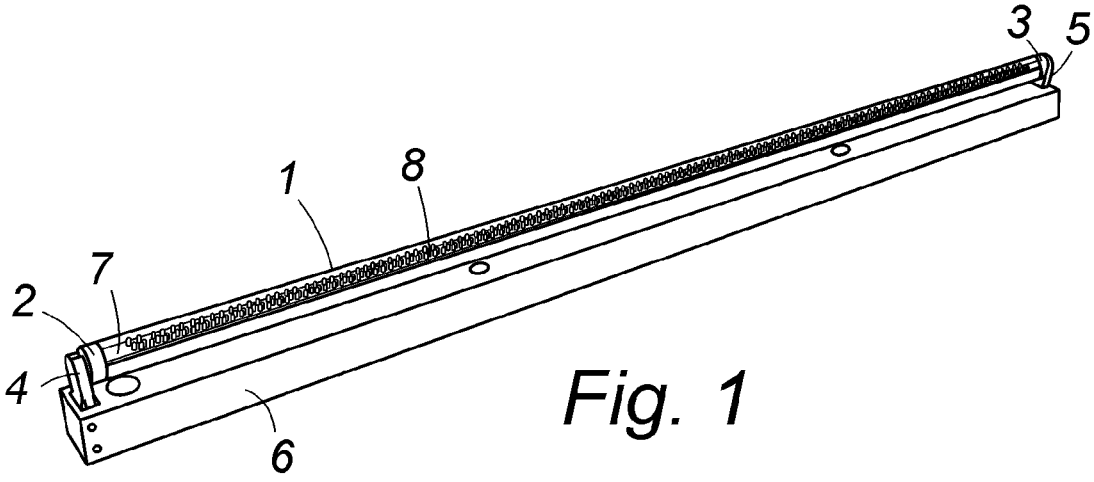
FIG. 1 shows a perspective view of an example of embodiment of the LED lighting tube that can be disassembled and repaired object of the invention, representing its main component parts and elements, as well as their configuration and disposition.
Figure 2:
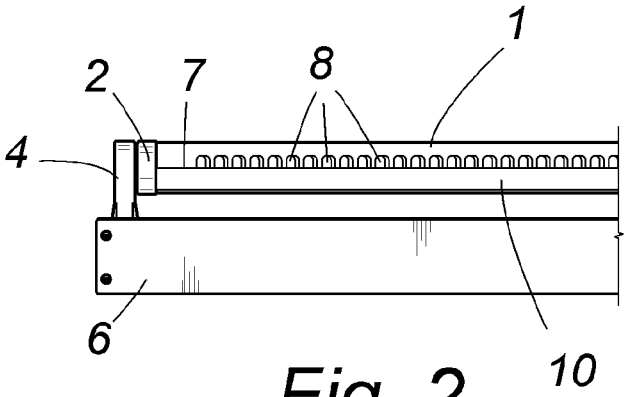
FIG. 2 shows an enlarged elevation view of a portion of the example of a tube according to the invention shown in the previous figure, that gives a clearer view of the disposition of the LEDs in the holding piece inside the tube and how this piece is anchored to the support.

As shown in FIG. 1, the invention essentially consists in a lighting tube constituted by a tubular body (1) of transparent material, such as glass or acrylic glass, on the ends of which are corresponding anchoring connectors (2) and (3) provided with means for attachment to corresponding lateral tabs (4) and (5) of a support casing (6).

Said tubular body (1) is internally provided with a piece (7) made of any flexible material suitable for its intended use which incorporates, distributed equidistantly on its surface, a plurality of LEDs (8).

This piece (7) has an elongated rectangular shape, with a length nearly identical to the length of the tubular body (1) and a width similar to or, optionally, slightly greater than the diameter of said tubular body (1).

Figure 3:
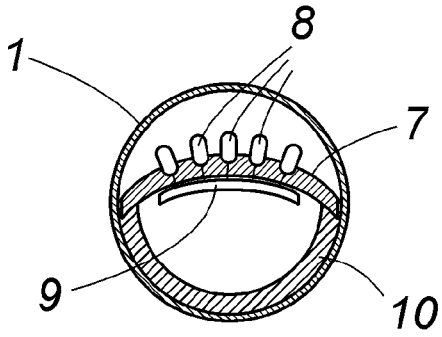
FIG. 3 shows a sectional view along a transverse cut of the tube according to the invention, in this case representing the curvature adopted by the holding piece on which the LEDs are placed and the support that allows this positioning.

Said piece (7) is inserted in the tubular body through one of its ends and, if it is wider than the latter as shown in FIG. 3, will define a curve that is convex on its outer side, in which the aforementioned LEDs (8) are coupled, providing an advantageous opening of the angle of incidence of the light. The opposite part of the piece (7) incorporates the electronic circuit (9) needed for its operation.

To set the concave positioning of the piece (7), it is considered to incorporate inside the tubular body (1) an internal support element (10) with a configuration having angled ends that sets acting as a guide, the sides of the piece (7) so that they assume said curvature. This internal support (10) is preferably opaque, as it is also used to embellish the rear part of the tubular body (1), concealing the electronic circuit (9) and the connections of the LEDs (8).

On another hand, at least one of the anchoring connectors (2) and (3) that close the ends of the tubular body (1) and are attached to the lateral tabs (4) and (5) of the support casing (6) is provided with a thread and a gasket to provide a full tightness of the tube and simplify the extraction and handling of the piece (7) inside the tubular body (1), this anchoring connector also having the connection element for power supply to the electronic circuit (9).

Having sufficiently described the nature of the present invention, as well as its practical execution, it is not considered necessary to extend this explanation further for any expert in the field to understand its scope and the advantages derived thereof. Without departing from its essence, it can be executed in other embodiments different from the one given by way of example whether in the shape, materials or dimensions, which will be also covered by the protection sought provided its main principle is not altered, changed or modified.

I claim:

1. An LED lighting tube assembly comprising:

a tubular body formed of a transparent material, said tubular body having a first end and a second end, said tubular body having a first anchoring connector at said first end and a second anchoring connector at said second end;

a piece of flexible material positioned in a convex curved manner interior of said tubular body, said piece of flexible material having an elongated rectangular shape and a length approximately equal to a length of said tubular body and a width slightly greater than a diameter of said tubular body;

a plurality of LEDs equidistantly distributed on a convex face of said piece of flexible material;

a circuit board connected to said plurality of LEDs and positioned on an opposite face of said piece of flexible material; and a support casing positioned exterior of said tubular body, said support casing having a first lateral tab and a second lateral tab extending outwardly at opposite ends of said support casing, said first lateral tab attached to said first anchoring connector, said second lateral tab attached to said second anchoring connector, at least one of said first and second anchoring connectors being threadedly and removably secured to the end of said tubular body, said at least one of said first and second anchoring connectors being sealed by a gasket to said tubular body, one of said first and second anchoring connectors having a connection element thereon suitable for connecting a power supply to said circuit board.

2. The LED lighting tube assembly of claim 1, further comprising:

a support positioned interior of said tubular body, said support having angled longitudinal edges, said piece of flexible material having longitudinal edges received respectively by said angled longitudinal edges of said support so as to set a convex curvature of said piece of flexible material.

3. The LED lighting tube assembly of claim 2, said support being formed of an opaque material.

* * * * *